US006213010B1

(12) United States Patent
Bolzoni

(10) Patent No.: US 6,213,010 B1
(45) Date of Patent: Apr. 10, 2001

(54) WOOD SHEET HEAT TREATMENT METHOD AND PLANT

(76) Inventor: Pierluigi Bolzoni, Via Sesto, 11, 26100 Cremona (IT)

( * ) Notice: Subject to any disclaimer, the term of this patent is extended or adjusted under 35 U.S.C. 154(b) by 0 days.

(21) Appl. No.: 09/484,419

(22) Filed: Jan. 18, 2000

(30) Foreign Application Priority Data

Jan. 18, 1999 (IT) ..... MI99A0077

(51) Int. Cl.[7] ..... B30B 15/34; B30B 5/06

(52) U.S. Cl. ..... 100/312; 34/430; 34/501; 100/310; 144/361; 144/364; 144/380

(58) Field of Search ..... 34/420, 429, 430, 34/433, 444, 500, 501, 561; 100/38, 302, 310, 312; 156/206, 398, 470, 581, 583.5; 144/359, 361, 364, 380

(56) References Cited

U.S. PATENT DOCUMENTS 2,800,162 * 7/1957 Rohdin ..... 100/312
4,336,096 * 6/1982 Dedekind ..... 100/310
4,362,593 * 12/1982 Grevich ..... 100/310
4,921,569 * 5/1990 Held ..... 100/312
5,303,644 * 4/1994 Held ..... 100/312

FOREIGN PATENT DOCUMENTS

2145749 * 9/1971 (DE) ..... 100/310
2136027 * 9/1984 (GB) ..... 100/310

* cited by examiner

*Primary Examiner*—W. Donald Bray
(74) *Attorney, Agent, or Firm*—Evenson, McKeown, Edwards & Lenahan P.L.L.C.

(57) ABSTRACT

A method for treating wood sheets in which individual sheets coming out of a dryer are sent to a continuous press to have them pass from a first temperature to a second temperature lower than the first while holding them under pressure in the passage. In accordance with this method the wood sheet treatment plant comprises a dryer (12,112) at the outlet of which there is a continuous press (13,113) with pressing tables (17,116,117) with controlled temperature to have the individual wood sheets pass from the first temperature to the second temperature while being kept under pressure during the passage.

8 Claims, 1 Drawing Sheet

WOOD SHEET HEAT TREATMENT METHOD AND PLANT

BACKGROUND OF THE INVENTION

The present invention relates to a method and plant for treatment of wood blanks and rotary cut veneer.

In the known plants, blanks and rotary cut veneer are passed through a dryer at whose outlet the sheets are stacked and sent in packs to the subsequent operations.

From normal dryers the product emerges severely undulated. There have therefore been proposed separate flattening treatments.

These treatments are performed before using the blanks and rotary cut veneer by placing the packs in purposeful presses. These presses are made up of two pressing tables in sequence, one heated and one cooled, usually served by a single conveyor belt which takes the packs from one table to the other.

Each pack is subjected to a first pressing under the hot table. The hot press flattens the material and the heat makes the wood malleable. The stay time under the hot press depends on the type of material and the thickness of the pack. Indeed, time is necessary waiting for the heart of the pack to reach the preset temperature also.

When the hot pressing operation is completed the press opens and the hot pack is conveyed under the cooled pressing table. The cold press closes on the pack, pressing it again but also removing heat from the wood by means of the refrigerating liquid running in the press table. Once the cold press is closed, it is again necessary to wait for the entire pack to cool to the preset temperature. This way the flat form of the sheets reached in the hot press stabilizes and the cold press can be opened and the pack is unloaded.

The pack treatment described above generates a considerable loss of time and can cause deformities among the outermost sheets and the more inward sheets in the various packs.

To remedy this there have been proposed dryers termed 'stretching dryers' in which during drying the sheet are subjected to a simultaneous stretching operation in order to avoid the subsequent pressing operation with hot-cold cycle. Although the sheets come out of these dryers flatter there can still remain residual undulations not always tolerable. In addition the stretching dryers are more costly and cumbersome and suffer from greater operating costs.

The general purpose of the present invention is to remedy the above mentioned shortcomings by making available a method and a drying plant delivering sheets with optimal planarity, rapidly and with relatively reduced costs and space occupied.

SUMMARY OF THE INVENTION

In view of this purpose it was sought to provide in accordance with the present invention a method for treating wood sheets in which the individual sheets coming out of a dryer are sent to a continuous press to have them pass from a first temperature to a second temperature lower than he first while holding them under pressure in the passage.

In accordance with this method it is also sought to provide a wood sheet treatment plant comprising a dryer for drying the wood sheets characterized in that at the outlet of the dryer there is a continuous press with pressing tables with controlled temperature for passing the individual wood sheets from a first temperature to a second temperature lower than the first while holding them under pressure in the passage.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the drawings.

DETAILED DESCRIPTION OF THE INVENTION

Figure 1:
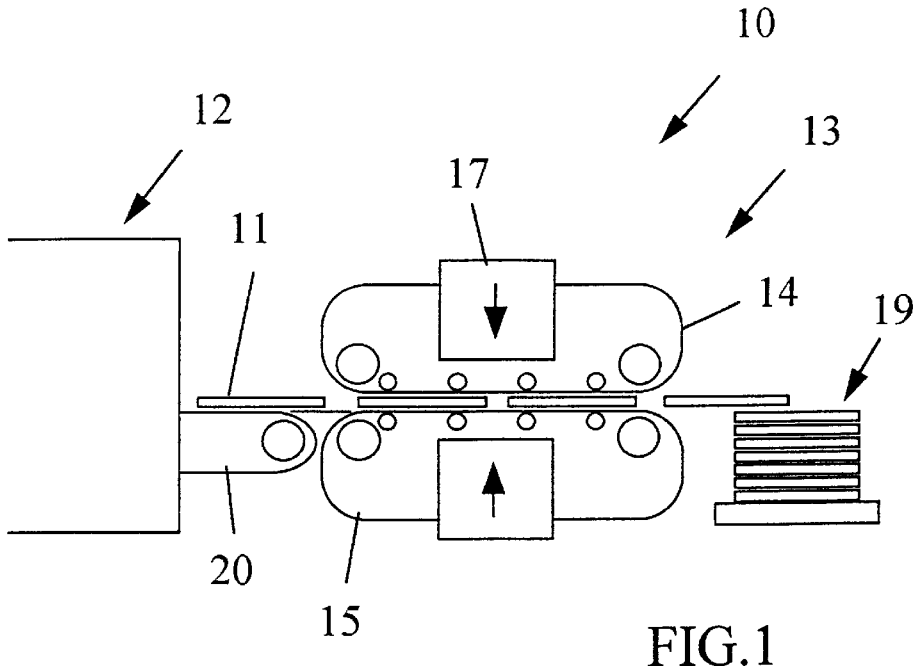
FIG. 1 shows a diagrammatic view of a first embodiment of a plant in accordance with the present invention.

With reference to the FIGS. FIG. 1 shows a first plant indicated as a whole by reference number 10 for drying and treatment of wood sheets 11.

This plant comprises a dryer part 12 followed by a pressurized heat treatment part 13. The dryer part is virtually conventional except as explained below e.g. of the type termed 'net' and also stretching if desired and is not further described or shown.

The sheets come out of the dryer on a belt 20 and are transferred directly to the heat treatment part 13. The part 13 is made up of a continuous press with belts 14, 15 between which run the sheets to move into a pressing zone 17. The belts 14 and 15 are metal or plastic belts which advance uniformly between two steel tables which generate the required pressure. The press tables are cooled in such a manner as to cool the sheets during their travel in the continuous press.

It is noted that the press 13 is a press of the type termed 'continuous', i.e. the sheets move continuously from the inlet end to the outlet end of the press.

The sheets coming out of the press 13 are then sent to the following operations e.g. packaged in a pack 19.

With the plant in accordance with the present invention the individual sheets coming out of the dryer are sent to the continuous press to have them pass from a first temperature to a second temperature lower than the first while keeping them under pressure during the passage. The first temperature is obtained during the drying process by regulating the process in such a manner that the sheets have the first temperature upon leaving the dryer. The sheets 11 thus come out of the dryer part 12 of the plant 10 still hot. The second temperature is obtained by appropriately regulating press table cooling.

It has been found advantageous that the first temperature be not less than 80° C. and the second temperature be not over 45° C. In particular the first temperature can be advantageously not under 100° C. and the second not over 40° C.

The sheets leaving the plant are perfectly flattened and stabilized.

The plant works continuously since the relatively small thickness of the individual sheets permits rapid sheet temperature change with no need of parking.

Figure 2:
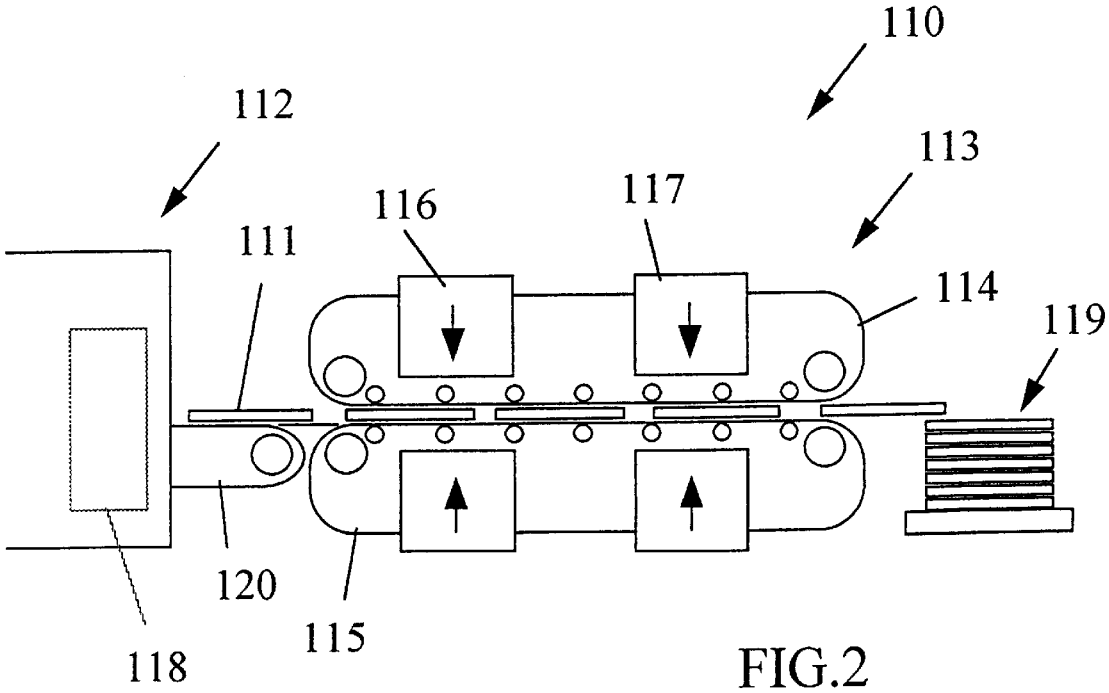
FIG. 2 shows a second embodiment of a plant in accordance with the present invention.

FIG. 2 shows a variant embodiment 110. In it the dryer 112 is equipped at the outlet with a cooling cell 118 which is usually present in dryers to obtain at outlet sheets with relatively low temperature and therefore easier to handle.

Air taken from the exterior is sent into this cell.

In other words the sheets are heated in the dryer to a drying temperature higher than the outlet temperature and then are passed through a cooling cell to take them to outlet temperature which is lower than the above mentioned first temperature.

A conveyor belt 120 takes the sheets immediately to the treatment part 113 made up of a continuous press with conveyer belts 114, 115 and press tables. The press tables are divided in two zones 116, 117 with the first heated and the second cooled. The sheets are made to leave the dryer and sent to the press with said temperature lower than the above mentioned first temperature. During the movement under pressure in the continuous press the sheets are first heated to said first temperature in the zone 116 and the cooled to said second temperature in the zone 117.

The flattened and stabilized sheets leaving the press part are then stacked in packs 119.

It is now clear that the predetermined purposes have been.

Especially the first preferred embodiment has undoubted advantages from the viewpoint of energy and space occupied.

The cost of the plant is also reduced. In addition the quality of the wood sheets is increased with respect to the flat sheets obtained by the prior art methods.

In both embodiments it is clear that the continuous press belts are synchronized with those of the dryer so that the sheets move continuously from one to the other.

Naturally the above description of an embodiment applying the innovative principles of the present invention is given by way of non-limiting example of said principles within the scope of the exclusive right claimed here.

What is claimed is:

1. Method for treating wood sheets, the method comprising the acts of:

providing individual wood sheets out of a dryer, sending said individual wood sheets to a continuous press, passing the individual wood sheets from a first temperature to a second temperature lower than the first temperature in the continuous press while holding the individual wood sheets under pressure in the act of passing.

2. Method according to claim 1 wherein the individual wood sheets are provided out of the dryer at an outlet temperature lower than said first temperature, and the act of passing includes heating the individual wood sheets to said first temperature, and cooling the individual wood sheets to said second temperature during movement under pressure in the continuous press.

3. Method according to claim 2 wherein the act of providing includes heating the individual wood sheets in the dryer to a drying temperature higher than said lower outlet temperature and passing said individual wood sheets through a cooling cell to take the individual wood sheets to said lower outlet temperature.

4. Method according to claim 1 wherein the first temperature is at least 80° C. and the second temperature is at most 45° C.

5. Wood sheet treatment device comprising:

a dryer for drying individual wood sheets having a dryer outlet, at the dryer outlet a continuous press with pressing tables, said pressing tables having temperature controllers to have the individual wood sheets pass from a first temperature to a second temperature lower than the first temperature while maintaining the individual wood sheets under pressure during passage through the continuous press.

6. Device according to claim 5 wherein the dryer has an outlet temperature lower than said first temperature, the continuous press having a heated first part to take the individual wood sheets to said first temperature and a cooled second part to take the individual wood sheets to said second temperature.

7. Device according to claim 6 wherein the dryer has a drying temperature higher than said lower outlet temperature, the dryer having at the outlet a cooling cell to cool the individual wood sheets to said lower outlet temperature.

8. Device according to claim 5 wherein the first temperature is at least 80° C. and the second temperature is at most 45° C.

* * * * *